United States Patent [19]

Kirkham

[11] 3,951,403

[45] Apr. 20, 1976

[54] STARTING ALIGNER FOR MOTOR VEHICLE RACING

[76] Inventor: Floyd L. Kirkham, 1003 W. Third St., Rushville, Ind. 46173

[22] Filed: Jan. 2, 1974

[21] Appl. No.: 429,938

[52] U.S. Cl. ..... 272/4; 119/15.5

[51] Int. Cl.[2] ..... A63K 3/02

[58] Field of Search ..... 272/4, 5; 273/55 R, 273/55 A, 86 R, 86 B; 119/15.5; 104/60; 404/10

[56] References Cited

UNITED STATES PATENTS

| | | | |
|---|---|---|---|
| 1,822,080 | 9/1931 | Cassidy | 119/15.5 |
| 1,916,951 | 7/1933 | Healy | 119/15.5 |
| 2,103,968 | 12/1937 | Mason | 119/15.5 |
| 2,526,060 | 10/1950 | Ashton | 119/15.5 |
| 2,602,666 | 7/1952 | Burke et al. | 273/55 R |
| 2,984,485 | 5/1961 | Brown | 273/55 R |
| 3,398,954 | 8/1968 | Nedwick | 273/55 R |
| 3,399,891 | 9/1968 | McCormick et al. | 273/55 R |
| 3,659,847 | 5/1972 | Gow | 273/55 R |

*Primary Examiner*—Richard C. Pinkham
*Assistant Examiner*—R. T. Stouffer
*Attorney, Agent, or Firm*—John J. Swartz

[57] ABSTRACT

Aligning apparatus for directing the passage of racing motor vehicles at the start of a race including: a frame overlying a race track, and resilient track dividers depending from the frame which define racing lanes through which the racing vehicles pass in parallel paths.

13 Claims, 9 Drawing Figures

STARTING ALIGNER FOR MOTOR VEHICLE RACING

BACKGROUND OF THE INVENTION

This invention relates to aligning apparatus for motor vehicle racing and more particularly to apparatus for directing the passage of racing vehicles at the start of a race.

High speed motor vehicle races are generally officially started with the vehicles traveling at a high speed after having traveled one or two pre-race laps around the track. The vehicles are generally aligned in parallel rows and the position of each vehicle is predetermined by time trials which might occur, for instance, throughout the weeks preceding the race. In the celebrated Indianapolis 500 race, which is customarily held at the end of May of each year, a pace car precedes the lead cars of parallel rows of racing vehicles during the warm-up laps. The pace car will drive to the inside of the track at the last turn preceding the starting line. Each racing vehicle is supposed to stay in its respective line until it has crossed the start line, after which it is permitted to negotiate the complete width of the track. As soon as the lead cars of the parallel rows reach the start line, the race is officially started. The natural tendency for the trailing racers upon seeing the starting signal is to drive immediately to anyplace on the track to pass the preceding cars even though the trailing cars have not yet crossed the start line. Since considerable numbers of cars are grouped together at the start, a major jam-up frequently occurs between the starting line and the first turn of the race causing serious accidents, such as that which occurred at the Indianapolis 500 race held in 1973. Accordingly, it is an object of the present invention to provide apparatus which will minimize the accidents occurring at the start of a motor vehicle race.

Another object of the present invention is to provide aligning apparatus for directing motor vehicles during their transit from their positions at the official start of a race to the official starting line.

It is a further object of the present invention to provide aligning apparatus for directing the movement of motor vehicles at the start of a race, including resilient track dividers for defining lanes through which the motor vehicles pass in side-by-side rows.

Yet a further object of the present invention is to provide motor vehicle aligning apparatus of the type described which can be easily removed from the race track when not in use.

A still further object of the present invention is to provide apparatus which positively requires the vehicles to pass beyond a predetermined line before they are at liberty to drive the full width of the race track at the official start of a race.

Other objects and advantages of the present invention will be more readily understood by reference to the accompanying drawings in which.

DESCRIPTION OF THE PREFERRED EMBODIMENT

Figure 1:
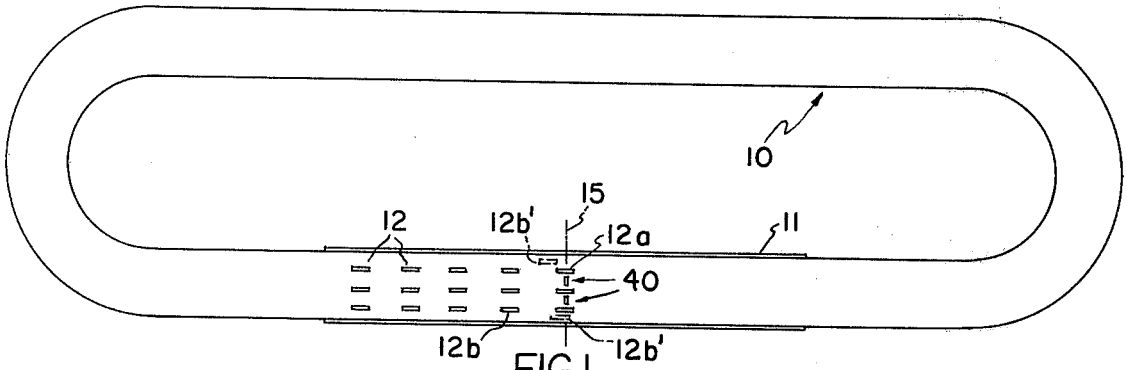
FIG. 1 is a top plan view of a typical race track.

Apparatus constructed according to the present invention is particularly adapted for use with an endless race track generally designated 10, such as the Indianapolis 500 Speedway located at Indianapolis, Indiana, and having sidewalls or rails 11. Prior to the official start of a race, a plurality of racing vehicles, generally designated 12, are serially aligned in parallel rows and travel about the track 10 for a number of pre-race laps. To start the race, the cars must generally be aligned in parallel rows when they approach the starting line 15 at which time they are traveling at a considerable speed, i.e., 120 miles per hour. In prior races not utilizing the apparatus disclosed herein, when the lead vehicles 12*a* reach the starting line 15, the race is officially started and frequently the drivers of the trailing vehicles 12*b* will immediately drive the trailing vehicles 12*b* out of line to the positions illustrated by chain lines at 12*b* '. When the vehicles 12*a* and 12*b* enter the first turn 16*a* abreast of each other, there is generally considerable congestion and frequently accidents occur, causing vehicle destruction and serious injury.

To prevent such congestion, apparatus generally designated 17 and constructed according to the present invention is mounted at the starting line 15 and includes a frame, generally designated 18, including an upstanding post 20 pivotally mounted in a vertical tube 22 which is fixed in the ground outside the inner race rail 11. Supported on the post 18 is a cantilever support framework, generally designated 24, which extends over the track and includes a generally horizontal support bar 26 fixed at its inner end to the post 20. An inclined bracing bar 28 spans the upper end to the post 20 and the free end 27 of the support bar 26. Reinforcing bars 29 span the bars 26 and 28 in a zigzag fashion to reinforce the framework 18. An operator support platform, generally designated 30, is provided at the laterally inner end of the support bar 26 and includes a plurality of laterally spaced, generally horizontal, differing length support bars 32 fixed to the underside of the support bar 26, and vertically spaced side rails 36 and inclined end rails 38. Also fixed to the underside of the bar 26 laterally outwardly of the operator support platform 30 is a plurality of relatively shorter, laterally spaced bars 34 for a purpose to be presently described. A plywood floor 31 is supported by the bars 32 and 34.

Depending from the main horizontal support bar 26 is a pair of laterally spaced lane dividers generally designated 40, each of which includes vertically extending laterally spaced, aluminum divider bars 42 pivotally mounted at 43 on the bar 26 and spanned at their lower ends by a plate 44. Pivotally mounted, via pivot pins 50, at the lower ends of the divider bars 42 are pads or flappers 46 comprising flexible material such as rubber. The pads or flappers 46 are typically formed of thin, semi-rigid, rubber sheets with large see-through central openings 52 therein so that the line of sight of the spectators and television cameras is not totally impaired.

Figure 5:
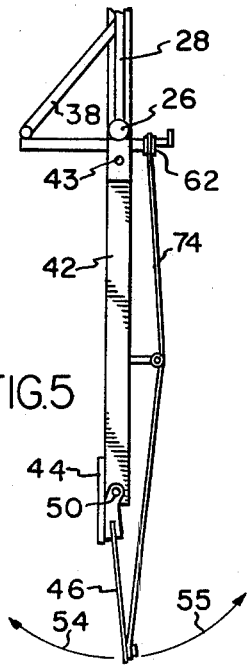
FIG. 5 is an opposite end view taken along the line 5—5 of FIG. 2.
Figure 6:
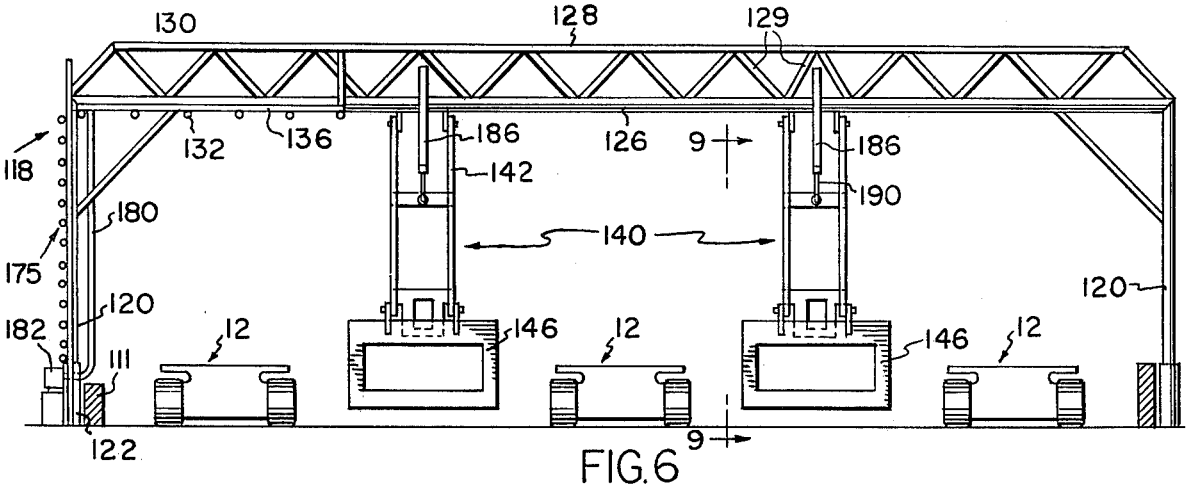
FIG. 6 is a front view illustrating a modified construction.
Figure 7:
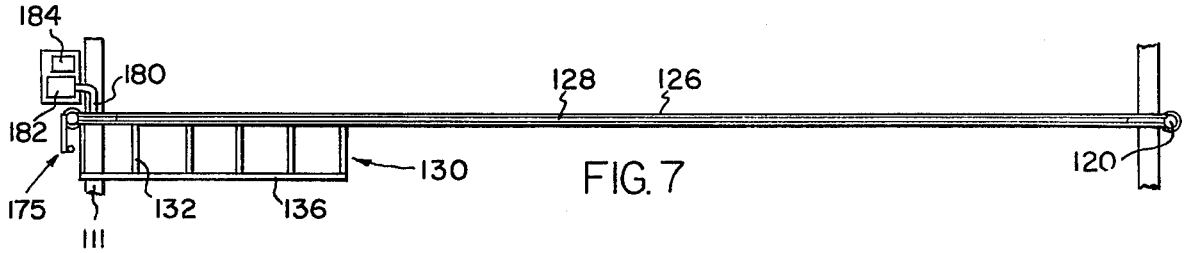
FIG. 7 is a top plan view of the embodiment illustrated in FIG. 6.
Figure 8:
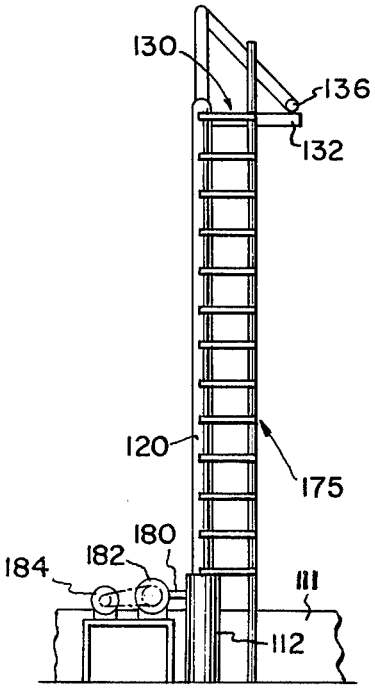
FIG. 8 is an end view of the apparatus illustrated in FIGS. 6 and 7.
Figure 9:
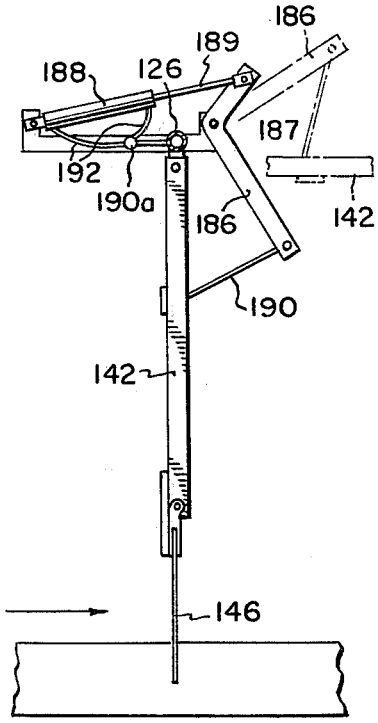
FIG. 9 is an enlarged view taken along the line 9—9 of FIG. 6.

This also lightens the weight of the flappers 46. The pads 46 may be brightly colored, so that they can be easily seen, and may typically be 5 feet wide and extend downwardly to approximately 12 inches above the track. The rubber pads 46 bear against the support plate 44 to prevent them from swinging upstream in a clockwise direction, represented by the arrow 54 (FIG. 5), while permitting them to swing downstream in a counterclockwise direction, represented by the arrow 55 (FIG. 5), in the event that a car 12 inadvertently bumps the rubber pad 46.

Figure 2:
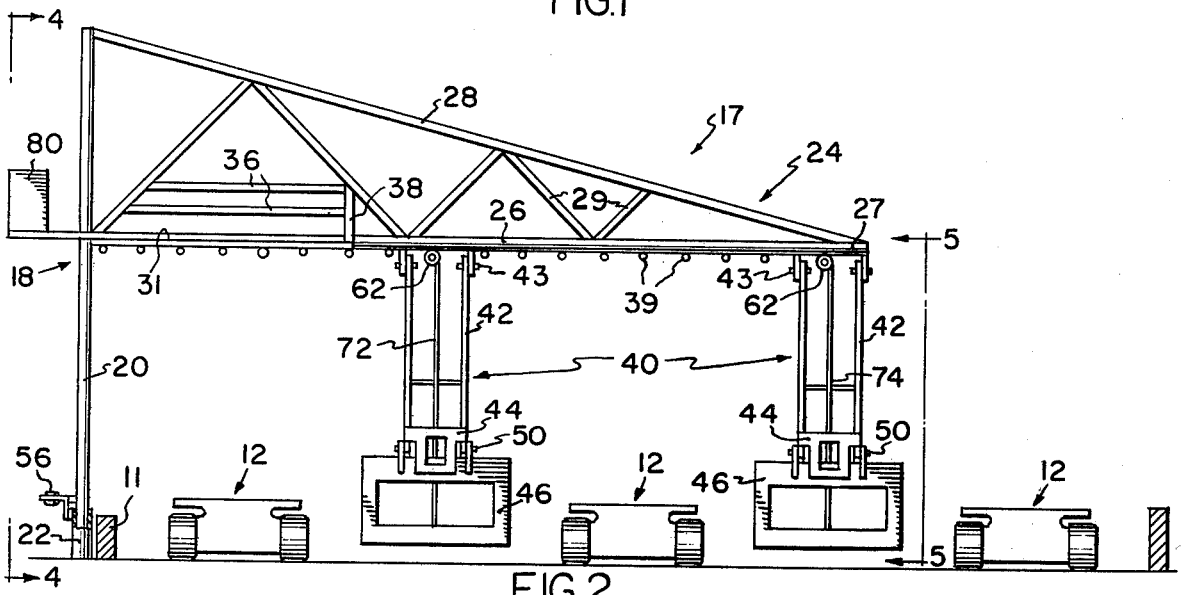
FIG. 2 is an enlarged front view illustrating aligning apparatus constructed according to the present invention mounted on a race track.
Figure 3:
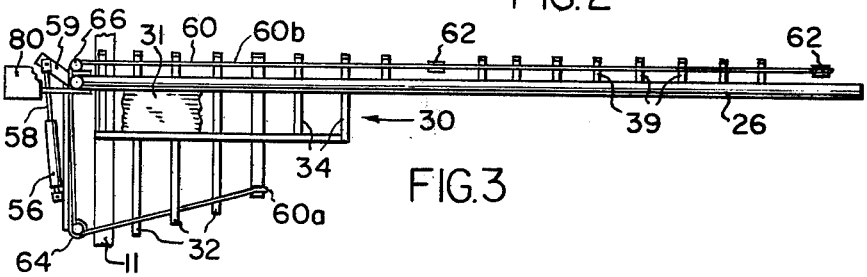
FIG. 3 is a top plan view thereof.
Figure 4:
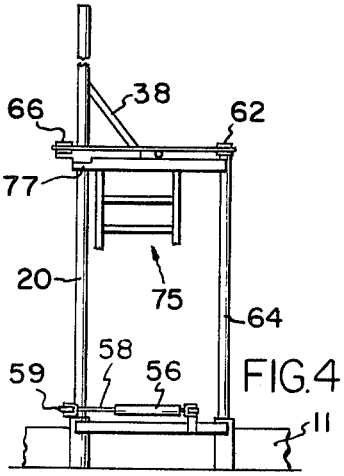
FIG. 4 is an end view taken along the line 4—4 of FIG. 2.

The maximum height of a racing vehicle 12 at the Indianapolis 500 is presently 32 inches and therefore, as illustrated in FIG. 2, the divider bars 42 terminates at a level substantially above the level of the cars 12 (i.e., 50 inches above the ground) so that an out of control vehicle 12 could pass directly under the bars 42 without hitting the bars 42. In the event that an out of control vehicle inadvertently became airborne and hits the bars 42, the bars 42 would merely swing upwardly about the pivot pins 43. The lower ends of the rubber pads 46 are substantially below the tops of the cars 12 so that the drivers will be required to pass between the adjacent pads 46 which are laterally spaced apart a distance that is substantially greater than the width of one car 12, but less than the width of two cars 12 so that two cars 12 could not pass between the pads 46 without touching the pads. For example, the maximum width of a car at the Indianapolis 500 is 80 inches and thus the distance between adjacent flappers 46 would never be greater than 1.8 times the width, or 144 inches. The width of the flappers might typically be 7 feet at the Indianapolis track which is 50 feet wide at the starting line.

Apparatus is provided for swinging the aligning framework 18 to a position generally parallel with the inner wall 11 and includes a double acting, solenoid actuated, fluid pressure operated cylinder 56 having a piston rod 58 connected to a crank arm 59 that projects from the lower end of the upstanding post 20. When the piston rod 58 is retracted, the aligning framework 17 will swing about the vertical axis of post 20 and will be pivoted 90° to a position outside of the track, generally parallel to the inner wall 11.

For raising the rubber lane defining pads 46 to a raised position in which they will clear the inner side wall 11 and also permit a substantially unrestricted spectator view of the cars 12, apparatus is provided for automatically raising the pads 46 in response to the swinging movement of the aligning framework 17 and includes cables 72 and 74 connected to the lower downstream sides of the rubber pads 46. The cables 72 and 74 are trained around pulleys 62 journaled on the support bar 26 and are joined to one end of a generally horizontal cable 60, having its opposite end **60*a* fastened to one of the platform bars 32. The cable 60 is trained around a pulley 62 journaled on an upstanding post 64 that is stationarily mounted in the ground outwardly of the wall 11, and a pulley 66 journaled on the upstanding pivotal post 20. The portion of the cable 60 adjacent the end 60*a* is supported on the laterally inner bars 32, whereas the portion 60*b* of the cable extending alongside the horizontal frame bar 26 is received in a trackway defined by upstanding end portions 68 of the horizontal bars 32 and 39. The end 60*a* of the fixed length cable 60 will automatically swing with the frame member 26 so that the cable branches 72 and 74 are drawn upwardly to swing the rubber lane defining pads 46 to the raised positions when the piston rod 58 is retracted and the aligning framework 17 is swung to a position parallel to the inside wall 11. A spiral ladder, generally designated 75, and leading to the operator platform 30, is mounted on the end of the platform 30. An upstanding post 64 is provided and mounts a crossbar 76 that includes a collar 77 journaling the upstanding post 20. A counterweight 80 is supported by the post 20 diametrically opposite the framework 18.**

THE OPERATION

The aligner 18 is conditioned for use by placing it over the track so that the divider bars 42 and the resilient pads 46 are in the positions illustrated in FIG. 2. The racing vehicles 12 will be driven in one or two pre-race laps. When the lead cars **12*a* reach the starting line 15, the starter of the race waves the "green flag" to officially start the race. This signals the drivers who might typically be traveling 120 miles per hour, that they are at liberty to drive anywhere on the track once they have passed through the aligning device 17. The aligning device 17 will thus force the drivers to pass serially the starting line 15. This will stagger the cars 12 which are free to travel anywhere on the race track and thus minimize the congestion at the first turn of the race. Once the cars pass the first turn, they naturally tend to become spaced along the length of the track. If one of the flappers 46 is hit by a front wheel of a car, for example, the flapper will be thrown upwardly, in the direction of the arrow 55, on the aluminum divider bars 42 and will immediately return to the position illustrated without any damage to the flapper or the car. The cylinder 56 would typically be operated to swing the starting aligner 17 to the position at the starting line 15 immediately after the last three cars of the three adjacent rows have passed by the start line 15 at the beginning of the first race lap. When the same last three cars have passed the starting line 15 after the official start of the race, the cylinder is operated to swing the framework 18 to a position in which it is parallel to the inner wall 11 and the pads 46** are retracted upwardly.

THE ALTERNATE EMBODIMENT

Referring now more particularly to the embodiment illustrated in FIGS. 6–9, a framework, generally designated 118, includes upstanding posts 120 on opposite sides of the track sidewalls 111 removably received in upstanding posts 122. A stainless steel, tubular support bar 126 spans the post 120 and mounts at one end an operator support catwalk or platform, generally designated 130, including a plurality of laterally spaced, horizontal bars 132 and vertically spaced side bars 136. Zig-zag bars 129 span the support bar 126 and a bracing bar 128. A ladder 175 is provided at the inside of the aligning framework 118 for permitting an operator to easily ascent to the platform 175.

The cross bar 126 is tubular and is connected to an upstanding tubular member 180 which is connected to a source 182 of pressurized air driven by a motor 184. The divider members 140 are identical to the members disclosed in FIGS. 1–4, except that the rubber flappers 146 hang more nearly vertical. Apparatus is disclosed for raising the aluminum divider bars 142 and comprises a crank arm 186 pivotally connected at 187 on the frame 118 and includes a double acting solenoid actuated cylinder 188, having a piston rod 189 for moving the crank arm 187 to the raised position illustrated in chain lines. A cable 190 couples the crank arm 186 to the aluminum bars 142 to concurrently raise the aluminum support bars 142 and the flappers 146 to a raised position at a level substantially above the track and the cars 12. Hoses 192 connect the cylinder 188 with a valve 190*a* which communicates air from the tube 126 to opposite ends of the cylinder 188. This tubular construction eliminates the necessity for an air tank to be supported on the frame 117 above the track.

It is to be understood that the drawings and descriptive matter are in all cases to be interpreted as merely illustrative of the principles of the invention, rather than as limiting the same in any way, since it is contemplated that various changes may be made in the various elements to achieve like results without departing from the spirit of the invention or the scope of the appended claims.

What is claimed is:

1. In combination with a motor vehicle race track of a predetermined width, and a plurality of racing motor vehicles of a predetermined maximum width relative to said track predetermined width to permit a plurality of said vehicles to move side-by-side along said track, said vehicles also being of a predetermined maximum height, said vehicles travelling on said race track in laterally adjacent rows at high speeds, the improvement comprising:

a starting aligner for directing the movement of said rows of vehicles during a prerace lap in a running start motor vehicle race including:

frame means having a mounting portion mounted adjacent one side of the track and a support portion supported by said mounting portion for extending over the track at a level above said predetermined maximum height; and track divider means depending from said support portion for dividing the track into lanes;

said divider means including yieldable means at the lower end thereof which terminates at a level below said maximum height but in spaced relation with said track, said yieldable means being of such lateral spacing relative to said track and said vehicles to provide passages through which vehicles in adjacent rows can simultaneously pass on laterally opposite sides of said yieldable means as the vehicles move side-by-side along the track.

2. The combination as set forth in claim 1 wherein said track divider means comprises a plurality of laterally spaced vertical divider bars, said yieldable means comprises a plurality of laterally spaced resilient members mounted at the lower ends of said divider bars, said divider bars being laterally spaced apart a distance greater than said predetermined width of one racing vehicle but less than twice said predetermined width.

3. The combination as set forth in claim 2 including means mounting said aligner on said track for bodily movement to one side of said track for storage when not in use.

4. The combination as set forth in claim 3 wherein the lateral width of said resilient means is greater than the thickness thereof in the direction of travel of said vehicles, said resilient means being provided with an opening therethrough to enhance visibility.

5. The combination as set forth in claim 2 wherein said divider bars terminate at a level about said maximum height and said resilient members extend to a level which is below said maximum height but above said track.

6. In combination:

an endless, motor vehicle race track of a predetermined width; a plurality of motor vehicle racing vehicles which travel in rows on the track at high speeds, said vehicles having a predetermined maximum width relative to said track predetermined width to permit a plurality of said vehicles to move side-by-side along said track, said vehicles also being of a predetermined maximum height; and a starting aligner for directing the movement of said racing motor vehicles in adjacent rows comprising;

frame means for overlying said track at a level above said predetermined maximum height; and track divider means, including support members depending from said frame means for dividing said track into lanes along which said vehicles pass on laterally opposite sides of said support members; and means for mounting said track divider means and frame means such that said support members terminate at a level above said predetermined height;

said track divider means including lane defining means, terminating at a level below said predetermined height, pivotally mounted on the lower end of said support members for free swinging movement in the event that said vehicles inadvertently strike said lane dividing means, between a rest position and a forward, downstream position.

7. The combination of claim 6 wherein said lane dividing means includes an aperture therein and means is provided which prevents said lane defining means from swinging upstream from said rest position.

8. In combination with a motor vehicle race track of a predetermined width, and a plurality of serially aligned racing motor vehicles of a predetermined maximum width relative to said track predetermined width to permit a plurality of said vehicles to move side-by-side along said track, said vehicles also being of a predetermined maximum height said vehicles travelling on said track at high speeds in laterally adjacent rows, the improvement comprising:

a starting aligner for directing the movement of said laterally adjacent rows of serially aligned racing motor vehicles during a prerace lap of a running start motor vehicle race comprising:

frame means having a mounting portion adapted to be mounted adjacent one lateral side of the track and a support portion supported by said mounting portion for extending over the track; and track divider means depending from said support portion for dividing said track into lanes, said dividing means including yieldable means at the lower end thereof;

means mounting said frame means on said one side of said track such that said yieldable means terminates at a level below said predetermined height but in spaced relation with said track and being of such lateral spacing relative to said vehicles and said track that vehicles in adjacent rows can simultaneously pass on laterally opposite sides of said yieldable means as the vehicles move side-by-side along the track;

the lateral width of said resilient means being substantially greater than the thickness thereof in the direction of travel of said vehicles, said resilient means being provided with an opening therethrough to enhance visibility.

9. The combination as set forth in claim 8 wherein said track divider means and said yieldable means are mounted such that said yieldable means is vertically movable, and means is provided on said support portion for vertically moving said yieldable means relative to said frame means.

10. A starting aligner for directing the movement of laterally adjacent rows of serially aligned racing motor vehicles of a predetermined height and width which travel on a race track of predetermined width at high speeds during a prerace lap of a running start motor vehicle race comprising:

frame means having a mounting portion adapted to be mounted adjacent one lateral side of the track and a support portion supported by said mounting portion for extending over the track;

track divider means depending from said support portion for dividing said track into lanes, when suspended thereover said divider means including yieldable means at the lower end thereof;

said mounted portion adapted for mounting said frame means on said one side of said track such that said yieldable means are spaced from each other to provide passages through which vehicles in adjacent rows can pass on laterally opposite sides of said yieldable means as the vehicles move side-by-side along the track;

said track divider means and said yieldable means being mounted such that said yieldable means are vertically movable between an operative lowered position and a raised stow position; and means is provided on said support portion for vertically moving said yieldable means between said operative position and said stow position;

said mounting portion comprising an upstanding post for mounting at one side of said track, said track divider means being mounted on said post for rotation about the vertical axis of said post; and means is provided for rotating said track divider means at least partially about said axis in an oscillatory path to selectively dispose said track divider means above said track;

said yieldable means comprising resilient members pivotally mounted on said divider means, said rotating means interacting between said support portion and said resilient member for vertically swinging said resilient members to a raised position.

11. The aligner as set forth in claim 10 wherein said divider means comprises a plurality of laterally spaced, vertical divider bars, said resilient members each comprises a rubber pad pivotally mounted on the lower end of one of said divider bars, said rotating means comprising cable means trained around pulleys on said support portion and connected to said rubber pads.

12. The aligner as set forth in claim 11 wherein said support members are pivotally mounted on said support portion, and means is provided at the lower ends of said support portion for preventing said pads from swinging upstream toward the vehicles.

13. The aligner as set forth in claim 12 wherein said cable means is trained around pulleys mountable at the side of the track and is connected to said frame means for swinging movement therewith so that said rubber pads raise automatically in response to swinging movement of said frame means.

* * * * *